United States Patent [19]

Hale

[11] 3,966,171

[45] June 29, 1976

[54] APPARATUS FOR LAUNCHING TOWING AND RECOVERING A SUBMERSIBLE BODY FROM A VESSEL

[75] Inventor: Neville E. Hale, Mississauga, Canada

[73] Assignee: Fathom Oceanology Limited, Port Credit, Canada

[22] Filed: Nov. 30, 1973

[21] Appl. No.: 420,375

Related U.S. Application Data

[62] Division of Ser. No. 327,003, Jan. 26, 1973, Pat. No. 3,782,319.

[30] Foreign Application Priority Data

Feb. 29, 1972 Canada ..... 135768

[52] U.S. Cl. ..... 254/190 R; 254/184; 114/235 B; 242/157.1

[51] Int. Cl.[2] ..... B66D 1/36

[58] Field of Search ..... 254/184, 150 R, 186 R, 254/190 R; 114/235 R, 235 B; 242/54, 77.1, 117, 157.1

[56] References Cited

UNITED STATES PATENTS

| | | | |
|---|---|---|---|
| 978,312 | 12/1910 | Lambert | 254/184 |
| 1,527,478 | 2/1925 | Harper | 254/184 |
| 1,984,604 | 12/1934 | Stahl | 254/184 |
| 2,780,196 | 2/1957 | Jareckie | 114/235 R |
| 3,168,287 | 2/1965 | Parola | 254/150 R |
| 3,174,726 | 3/1965 | Atkinson et al. | 254/190 R |
| 3,360,242 | 12/1967 | Lawrence | 254/184 |
| 3,391,879 | 7/1968 | Bus, Sr. | 242/117 |
| 3,432,146 | 3/1969 | Schubert et al. | 254/150 R |
| 3,576,295 | 4/1971 | Hale | 254/184 |
| 3,589,641 | 6/1971 | Lawrence | 254/186 R |
| 3,604,387 | 9/1971 | Hale et al. | 114/235 R |
| 3,794,296 | 2/1974 | Hasstedt | 254/139.1 |

*Primary Examiner*—Robert J. Spar
*Assistant Examiner*—Kenneth Noland

[57] ABSTRACT

Apparatus for launching, towing and recovering a submersible and towable body from a vessel includes a saddle, a winch and cable spooling and tension apparatus. The saddle includes a roller box which is rotatable about the axis of the tow sheave to maintain constant pressure against the cable during towing. A skewable A-frame for lowering the saddle near the water surface includes a transom arm which is pivotally mounted to the transom and to the tow sheave. The winch may be a multi-drum assembly, where the drums are co-axially mounted; and the drums are rotatably mounted in peripheral bearings at each end, which are mounted in the ends of the winch enclosure. The winch enclosure has a cover plate with a transverse slot to permit reeling and unreeling of cable from a drum. A latch mechanism provides for positive locking of a drum for rotation or non-rotation, depending on whether it or another drum is the one on which cable is being reeled or unreeled. The drums of a multi-drum assembly also have a transverse slot formed in them; and the lips of each slot are profiled to turn inwardly with a smaller apparent radius of curvature than the nominal radius of the drum.

10 Claims, 21 Drawing Figures

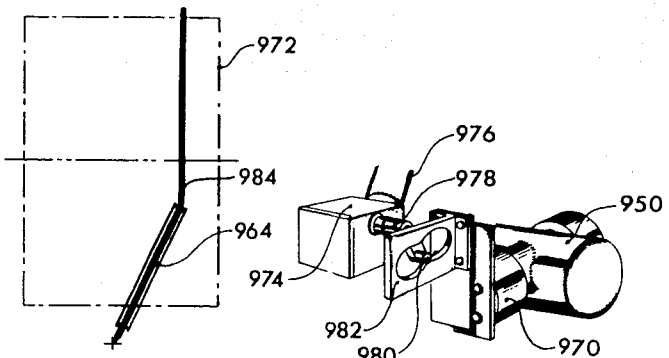
FIG. 10
FIG. 11
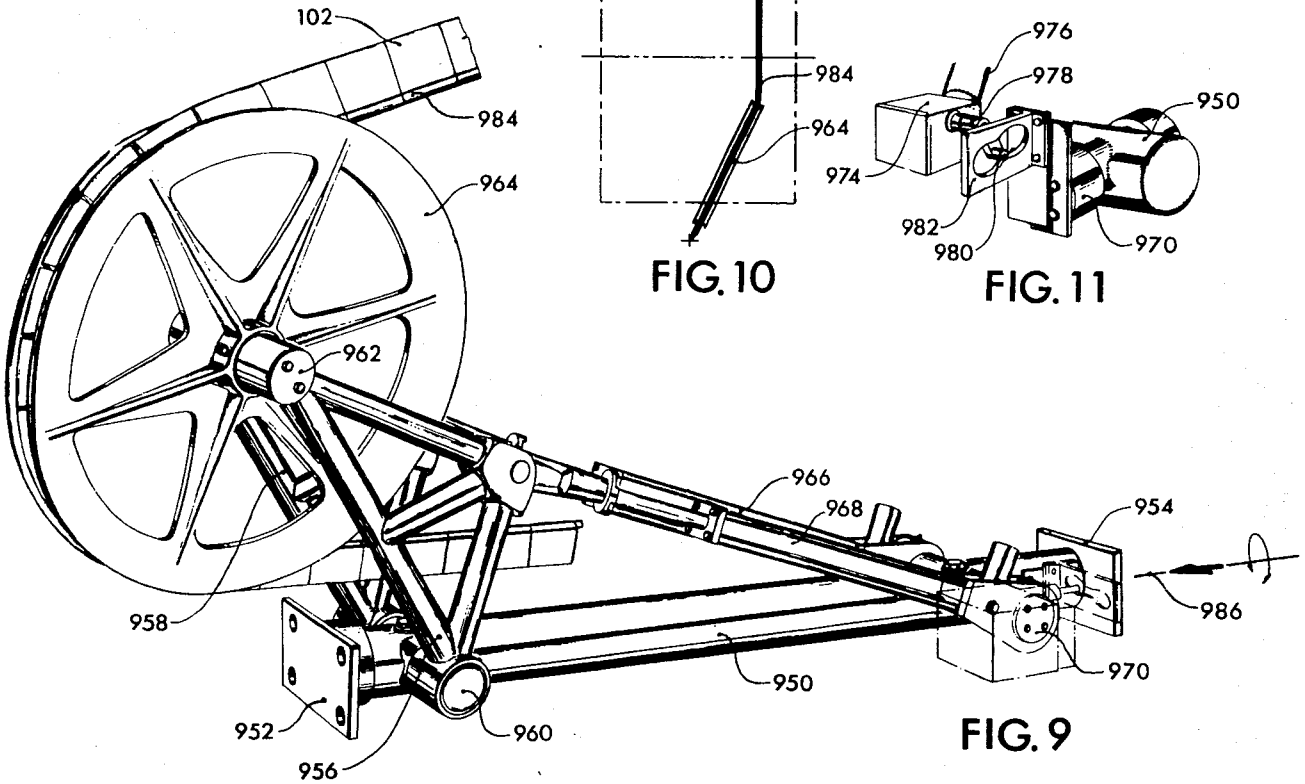
FIG. 9

APPARATUS FOR LAUNCHING TOWING AND RECOVERING A SUBMERSIBLE BODY FROM A VESSEL

CROSS-REFERENCE TO RELATED APPLICATION

This application is a division of application Ser. No. 327,003 filed Jan. 26, 1973 and which is now U.S. Pat. No. 3,782,319.

FIELD OF THE INVENTION

This invention relates to apparatus for launching, towing and recovering a submersible and towable body from a vessel. In particular, this invention relates to apparatus which is adapted to insert a towable body through the air/water interface, and to recover the body from beneath the surface of the water; including specific apparatus for reeling and unreeling cable from which the towed body is suspended, apparatus for maintaining and stabilizing cable tension, and a launch and recovery apparatus which permits the launching and recovery of the body from a saddle which can be moved very close to the waters surface while maintaining the length of cable paid out from the cable stowage apparatus.

BACKGROUND OF THE INVENTION

There may be many reasons for the requirement to tow a submersible and towable body from a vessel, including naval and other military reasons relating to national security and the like; as well as oceanologic and oceanographic testing and exploration. The nature of the towed body, and its size may vary considerably depending on the use to which it is put. In most cases, however, a submersible and towable body is one which is adapted to be flooded with water after it is inserted through the air/water interface from being stowed on board the vessel from which it will be towed; and usually the body is constructed with relatively fragile or frangible areas on it, as compared with the construction of a sea-going vessel. Submersible and towable bodies may, indeed, be substantially acoustically apparent at certain frequencies for sonar or other acoustic exploration and searching operations. The towable body may also carry apparatus for continuously sampling the water which it is being towed. The operational requirements for the submersible and towable body may be such that the apparatus from which the body is launched and recovered, as well as towed, be adapted to operate in very heavy sea states and at very high speeds. Heavy loading on the apparatus due to wave slap, tow-off, and other shock loading, and the requirement to launch and recover a submersible and towable body at high speed, would be expected to result in the production of an apparatus therefore which would be very heavy and massive. Unfortunately, many vessels do not have the deck space or capacity to carry very heavy and bulky equipment.

Certain specific problems relating to the launching and recovery of a submersible and towable body, from a vessel - including such vessels as hydrofoils and ground or surface effect vehicles (air cushioned vehicles) as well as more conventional ocean going trawlers and naval vessels - have required consideration. They include the fact that the submersible and towable body should be launched and recovered from a saddle to which it can be secured with cable tension of the cable from which the body is towed while the body is still beneath the surface of the water and before it is brought through the air/water interface. Further, where the vessel has a high deck, it is desirable to provide launching, towing and recovering apparatus without necessitating extensive modification to the vessel and which can be installed on the vessel in a minimum of time. Means are provided by this invention for tilting the entire deck frame on which the cable winch and the towable body handling apparatus are mounted. A skewable A-frame which includes a transom arm mounted at the aft end of the vessel is therefore contemplated by this invention.

When a body is being towed from a vessel, it is secured at the outer end of the cable which is reeled and unreeled from a winch located on the vessel. At any time while the body is submersed and it is not being securely held into its saddle by the cable which is in tension — in other words, whenever there is cable unreeled from the winch — it is necessary to provide cable tension stabilizer means to prevent snap loading of the cable such as when the vessel moves through rough waters. In accordance with the present invention, and considering the usual installation of an apparatus as contemplated by this invention aboard ship, the cable leads forward from the winch over a spooler and cable tension stabilizer assembly which may comprise one or more sheaves, and thence rearwards from the cable spooling assembly to the towing sheave which is situated lengthwise along the cable between the winch and the towed body and which also forms part of the apparatus of the present invention. The cable tension stabilizer may conveniently comprise a shock absorber associated with the cable spooling assembly.

Whenever cable is reeled or unreeled from a winch over a spooling assembly, and the cable does not lead from the reeling point on the winch to the spooling assembly at substantially a right angle to the surface of the drum on which the cable is wound and therefore at a right angle to the axis of rotation of the drum, the angle which results is known as a "fleet angle". Especially when a cable which is being reeled or unreeled from the drum of a winch is in tension, and more especially when the cable is faired, it is desirable to maintain the fleet angle as close to zero as possible. In a preferred embodiment of this invention, as discussed hereafter, the fleet angle is essentially maintained at zero by the use of a multiple sheave assembly which is adapted to move in such a manner as to keep the cable reach from the winch to the cable towing sheave as short as possible; and because of the geometry of the assembly, the fleet angle at the winch is maintained at substantially zero.

It is also desirable to provide a winch construction on which a cable — especially a faired cable — may be reeled and unreeled, which is capable of withstanding high side loading but which takes up as little onboard space as possible. Especially in military installations, the requirement for the winch to withstand high athwartships shock is a very real one, and in any event the roll of a ship may cause considerable loading on the winch. A conventional port 1 frame cannot be cross-braced in the usual manner because of the swept area taken up by the drum or drums of the winch, and therefore the vertical supports of such a frame and the athwartship member have to be designed to be very large in order to accommodate the twisting loads which might be encountered. This invention contemplates a winch construction of a "wrap-around" type wherein an enclosure frame substantially encloses the winch drum, with a transverse slot formed in the enclosure and with the winch drum or drums bearingly mounted in the end of the frame. Very substantial athwartships rigidity is thereby achieved in a minimum of athwartships space and with a lower weight. Also, of course, the frame enclosure provides protection of the stowed cable against ice build-up; and because the cable is stowed under tension, considerably less hazard due to cable breakage is afforded for personnel working near the winch.

Where a considerable length of cable is to be stowed by the winch — for example, in excess of 1,000 feet — the winch construction may comprise two or more drums which are coaxially mounted. The drums are arranged with a transverse slot in the surface of each drum except the innermost one so that cable may be reeled and unreeled from the multiple drum assembly; with the cable being unreeled serially from the outermost to the inner most drum and reeled serially from the innermost to the outer most drum. However, to maintain alignment of the transverse slots in each of the drums which is outwards of the drum on which cable is being reeled or unreeled, it is necessary to latch those outward drums for nonrotation. Also, because only the innermost drum is driven, it is necessary to latch the innermost drum and any other drums having cable reeled upon them with the drum upon which cable is being reeled at any one time for rotation so as to be driven by the winch drive means. Still further, it is desirable to provide latch means for automatically latching or unlatching adjacent ones of the drum as cable is reeled onto or off those drums without having to stop the outboard or inboard (i.e. unreeling or reeling) movement of the cable relative to the winch. Automatic latching means are therefore provided by this invention which meet the above requirements with respect to non-stop reeling in a multidrum winch.

Because the cable is wound under tension, and because in most circumstances the cable may be faired, it is necessary to provide a multidrum winch assembly wherein the clearance between drums is sufficient to permit stowage of cable on a drum having a transverse slot without interference of the cable on that drum with the cable which is stowed on the drum immediately inwards thereof. Also, it is desirable to reduce the radial loads in the material of the drum to zero load at the edges of the transverse slots. This invention therefore provides a drum construction wherein the lips formed on the transverse edges of each transverse slot are curved inwardly towards the interior of the drum with an apparent radius of curvature being less than the nominal radius of that respective drum. By so doing, a slotted drum construction for a multidrum assembly can be provided having a strength comparable to a conventional, unslotted drum; and therefore the multidrum winch construction is capable of reeling and unreeling and stowing cable which is in tension.

It is desirable when working with a faired cable to provide a slotted drum surface to accommodate that cable. This invention contemplates the provision of a slotted or grooved drum section by the application to the surface of the material from which the drum is formed of an outer layer of relatively flexible material which has a cross-section so as to form the desired grooves at the outer surface of the drum.

This invention also contemplates the provision of a roller box assembly which forms part of the launch and recovery saddle for the submersible and towable body and which can be accommodated to saddles of the non-inverting type. In the usual case, the present invention contemplates an inverting saddle for the most effective and economical structure for launch and recovery of the submersible and towable body at the air/water interface. However, other structures also exist whereby a saddle is rigidly fixed with respect to the horizontal — at least as defined by the deck of the vessel — and where the saddle is moved to the air/water interface by means of a pantographic assembly. However, it would be desirable to tow the body from a tow sheave which is intimately associated with the recovery saddle, and also to provide means for maintaining a constant pressure against the nose of a faired cable as it passes from the two sheave to the towed body as it is underwater. This is especially true when the cable is faired so that the body tends to be towed in a position which is very nearly beneath the vessel; and so that the cable pierces the air/water interface (the water surface) in a nearly vertical orientation. Still further, however, is the requirement that a roller box be provided which not only has a nose roller but which has side rollers, one on either side of the cable, and that the roller box be biased so as to maintain a position relative to the cable as it passes through the roller box so that the axes of the side rollers are substantially perpendicular to the axis of the cable. This is especially important when towoff occurs as the vessel turns or rolls, so as to preclude a tendency of the cable to corkscrew. It is also important, during towoff, that the roller box be adapted to absorb sideways loading as the side rollers make contact with the cable.

DESCRIPTION OF THE PRIOR ART

The above discussion has related particularly to certain of the desiderata which surround the present invention and various aspects thereof. These desiderata and the objects of the invention annunciated hereafter may be more clearly appreciated when considered in view of the prior art, of which the most relevent prior art is believed to include U.S. Pat. No. 2,780,196 issued Feb. 5, 1957 to Jareckie for "Hoist Boom Towing Connection"; Hale et al. U.S. Pat. No. 3,604,387, issued Sept. 14, 1971, for "Means for Launching, Towing and Recovering an Oceanographic Towed Body in a Seaway"; and Hale U.S. Pat. No. 3,576,295, issued Apr. 27, 1971 for "Means for Stowing Crush-sensative Cable Configurations". The latter two patents are assigned to a common assignee with the present invention.

The Jarackie patent teaches an earlier launch and recovery apparatus which includes a pantographic movement to swing the towed body aboardships from the air/water interface. Such apparatus is subject to very high transverse loads, and is such that it is not possible to maintain constant cable length while the body is secured against the saddle.

The Hale patent relating to the means for storing crush-sensative cable configurations teaches a winch construction which may be single or multidrum. However, the supporting means for the drum construction is heavy and considerably wider than the width of drum upon which cable may be wound. Also, the latching means between drums are such that reeling or unreeling operation must be stopped by stopping rotation of the driven drum.

The Hale et al. patent teaches an earlier apparatus for launching, towing and recovering a towed body; but that patent teaches the fundamental principle of an inverting saddle. However, the apparatus taught in the earlier Hale et al patent has no provision for moving the saddle downwards to the air-water interface except by inverting it around the axis of rotation of the tow sheave, and therefore the apparatus is not useful in vessels having high decks. The Hale et al. patent also teaches the provision of free lateral movement for a spooling sheave so as to overcome fleet angle problems; and a spring biased saddle which tended always to "float" upwards so as to maintain pressure of a nose roller against the cable during towing operation, particularly so as to preclude the possibility of the cable escaping from the saddle. The present invention, therefore, provides improvements to the earlier Hale et al invention in those matters.

BRIEF SUMMARY OF THE INVENTION

An object of this invention is to provide an apparatus for launching, towing and recovering a submersible and towable body from a vessel, including improved means whereby a deck frame upon which a winch, towing sheave and launching and recovery saddle are mounted may be tilted on a transom arm means which forms one leg of a skewable A-frame; so that by tilting the deck frame and moving the tow sheave and saddle close to the air/water interface, the length of cable between the winch and the body does not change until it is desired to move the body through the air water interface. A compact apparatus for launching, towing and recovery of a submersible body is therefore provided for installation on a vessel.

Another object of this invention is to provide a cable spooling assembly for use in association with a winch upon which cable which is in tension may be reeled and unreeled, and stowed.

A further object of this invention is to provide a winch construction comprising one or more drums upon which cable may be reeled and unreeled — the second and subsequent drums being mounted coaxially with the first drum in a multidrum assembly — and where the drum means is supported by a frame including a "wrap-around" enclosure plate between the ends in which the drum means is rotatably mounted, and without massive external support or stress-relieving structures.

Yet a further object of this invention is to provide a latching assembly for latching any two adjacent drums in a multi-drum winch assembly where the drums are coaxially mounted, which latching assembly is automatically operative without stopping the reeling or unreeling operation of the winch and which latches a given drum for rotation or non-rotation as required, depending on whether that drum or the next adjacent drum is the one from which the cable is bein reeled or unreeled.

A still further object of this invention is to provide a drum construction for a multi-drum winch assembly wherein all the drums except the innermost have a transverse slot formed therein, and where the lips at the edges of each transverse slot are formed so as to provide stress relief in the material of the drum when the drum is loaded with cable which is in tension. Also, a drum construction is provided whereby the outer surface of each drum has grooves formed thereon to accommodate a cable which is to be wound on that drum, and where the grooved surface is accomplished by securing an outer layer of relatively flexible material having an appropriately formed cross-section to the surface of the drum.

Yet another object of this invention is to provide a roller box for use in association with the recovery and stowage saddle for a submersible and towable body, where the roller box is adapted to maintain a specified attitude with respect to a cable passing therethrough as the body is being towed; and where the roller box may be mounted independently of the saddle, if required.

BRIEF DESCRIPTION OF THE DRAWINGS

These and other objects and features of this invention are more clearly discussed hereafter, in association with the accompanying drawings, in which;

FIG. 9 is a perspective view of an alternate alternate cable spooling assembly and cable tension stabilizer.

FIG. 10 is a diagramatic view showing the relationship between the cable spooling assembly of FIG. 9 and a winch drum.

FIG. 11 is a perspective view showing drive means for driving the cable spooling assembly of FIG. 9.

FIGS. 14A to 14G are diagrammatic, progressive representations illustrating the operation of the latching mechanism according to this invention.

DESCRIPTION OF THE PREFERRED EMBODIMENTS

Figure 1:
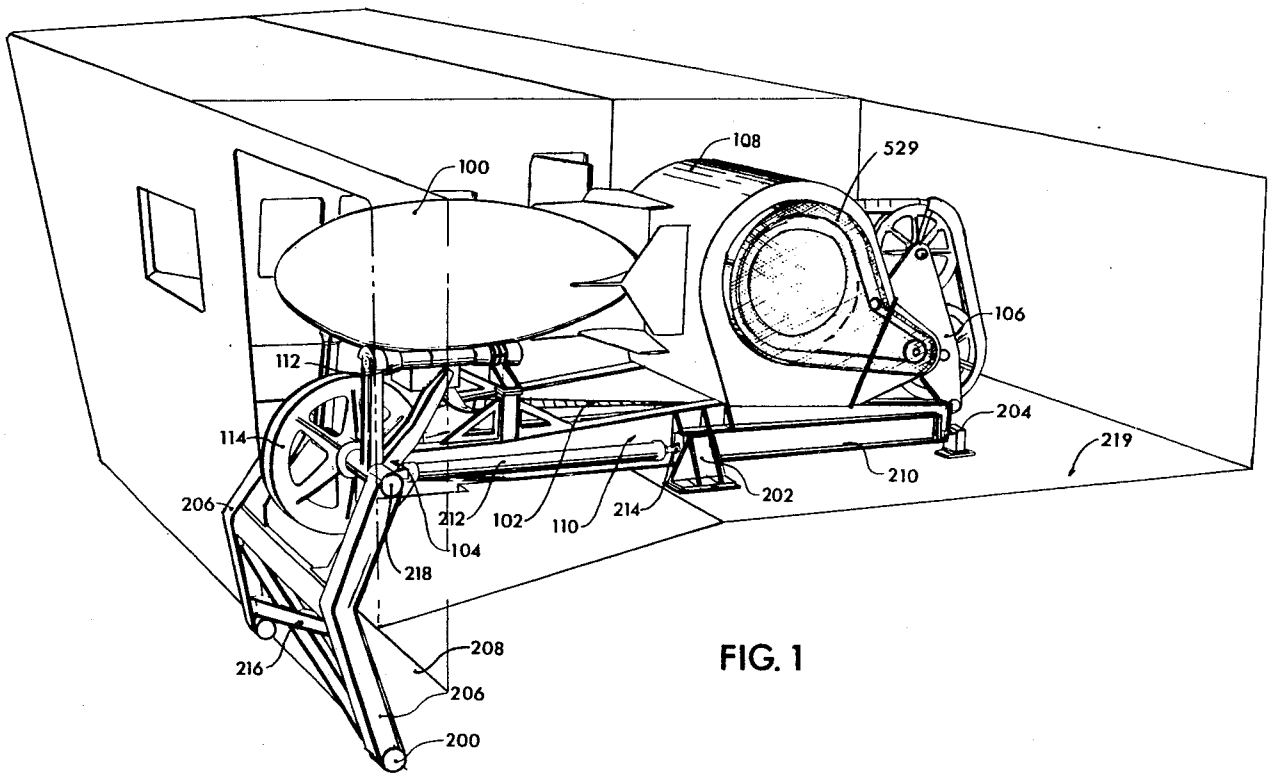
FIG. 1 is a general perspective view of a preferred embodiment of the apparatus according to this invention.

There follows hereafter a description of several embodiments of apparatus as contemplated by this invention. In particular, the following discussion relates to a preferred embodiment and an alternative embodiment of apparatus contemplated by this invention, which in each case embodies the principles defined herein but which may vary as to detail of the integers and mechanical components. Discussion is made of certain particular aspects of the present invention, including alternative arrangements for a transom arm, alternative arrangements for a cable spooling assembly, an enclosed multi-drum winch, a latching mechanism for multi-drum winch, the drum and surface construction and configurations of multi-drum winches, and alternative arrangements for a roller box and saddle assembly. Whenever appropriate, and for the sake of continuity and clarity of meaning, like reference numerals are used in various figures of the drawings to refer to the same integer.

As noted above, it is a major consideration of the present invention to provide an apparatus whereby a towable and submersible body may be launched, towed and recovered from the vessel while the vessel is moving. The apparatus discussed herein is such as to withstand heavy shock loading on the cable or on the apparatus itself, including sideways or athwartships loading on the winch or the saddle and or roller box; so as to take into account military requirements as well as the practical, physical requirements of high speed towing in heavy seas. Also, as noted, when a submersiable and towable body is to be towed in the water, it is preferable to physically force the body through the air/water interface for initial submersion while the body floods; because the body may have negative buoyancy when dry, and so as to preclude the possibility of snap loading the tow cable. When the body is being towed, especially with the faired cable, it may be very nearly beneath the vessel. It is desirable to provide an apparatus which maintains cable tension and is able to accommodate movement of the vessel as it rolls or pitches.

FIG. 1 shows a preferred embodiment of the apparatus as contemplated by this invention; and includes a submersible and towable body 100 which is intended to be towed with a faired cable 102. The cable 102 is stowed in winch assembly 108, and is reeled and unreeled therefrom. A spooling assembly and cable tension shock absorbers is indicated generally at 106. A pivoting saddle assembly is indicated at 104; and the saddle assembly 104, cable spooling assembly 106 and winch assembly 108 are all mounted on a deck frame indicated generally at 110.

Figure 2:
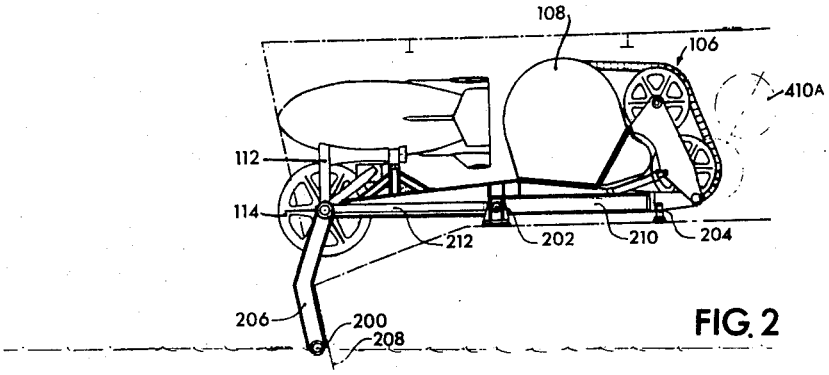
FIG. 2 is a side elevation of apparatus such as that shown in FIG. 1, showing the towed body in the stowage position.
Figure 3:
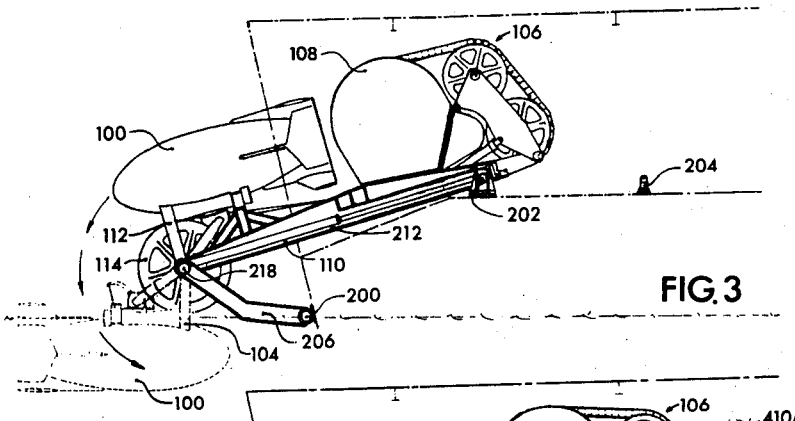
FIG. 3 is similar to FIG. 2, and shows the apparatus in an extended position for launch and recovery of the towed body.
Figure 4:
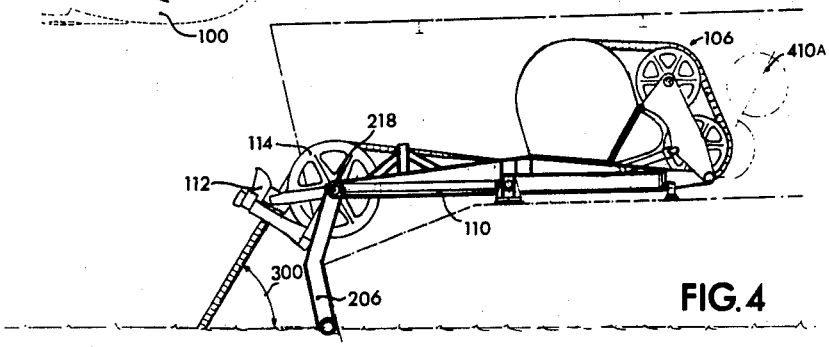
FIG. 4 is similar to FIGS. 2 and 3 and shows the apparatus during a towing operation.

Referring to FIGS. 2, 3 and 4, along with FIG. 1, it will be seen how the towable and submersible body 100 is moved from its stowage position as indicated in FIGS. 1 and 2 to the recovery and launch position indicated in FIG. 3. The towing position is indicated in FIG. 4. In the apparatus of FIGS. 1 to 4, when the towed body 100 is in its stowage position as in FIGS. 1 and 2, the entire weight of the apparatus is transferred to the vessel at three points per side. Those three points are indicated at 200, 202 and 204. It will be noted that the point indicated at 200 at the lower end of a transom arm 206, and each transom arm 206 is pivotally attached to the vessel at its respective point 200. Suitable cross bracing 216 may be placed between the transom arms 206. The load transfer point 202 may conveniently comprise a roller assembly which is secured to the mounting deck 219 of the vessel. The roller assembly 202 is adapted to engage with track assembly 210 which forms part of the deck frame 110. The load pickup point 204 is also secured to the deck 219 and it is adapted to support the forward end (relative to the vessel) of the deck frame 110.

A pair of hydraulic cylinders 212 may conveniently be attached to the deck frame 110, one on either side thereof, so that the ends of the hydraulic cylinders at 214 are pivotally attached near the load pickup point 202.

The saddle assembly 104 comprises, interalia, an inverting saddle 112 and a rotatable towing sheave 114. The axis of rotation of the saddle 112 and sheave 114 is indicated generally at 218.

When it is desired to launch the body 100, the hydraulic cylinders 212 are extended as indicated in FIG. 3. It will be noted that the entire deck frame 110 is moved backwardly and downwardly with respect to the vessel, and particularly that a transom arm 206 which is pivotally attached to the transom 208 at point 200 is pivoted backwardly and downwardly. It will also be noted that the entire weight of the apparatus with the body 100 still in it's stowage position as shown in full lines in FIG. 3 is picked up and transferred to the vessel at points 200 and 202; and therefore that the transom arms 206 and the deck frame 110 form a skewable A-frame having its apex at the axis of rotation 218. It will also be noted that the length of cable from the winch 108 to the outer end of the cable where it is secured to body 100 is unchanged as the skewable A frame is skewed and the axis of rotation 218 of the saddle is brought close to the water surface. By releasing a suitable brake assembly on the winch 108, the saddle 112 is permitted to invert from the stowage position to the position indicated in ghost lines in FIG. 3, because a certain amount of cable is permitted to unreel from the winch 108. However, only sufficient cable to permit the inverting of the saddle is first unreeled from winch 108, as the body pierces the air/water interface and is securely held in its saddle 112 below the surface of the water for flooding period. Further cable is then permitted to be unreeled from the winch, and the body begins to sink and tow in a submerged condition. When the body is sufficiently below the surface, the hydraulic cylinders 212 are retracted, and the deck frame 110 and transom arms 206 assume their original position, but with the body being towed as indicated in FIG. 4. Thus, the skewable A frame which is formed by the deck frame and the transom arm pivoted to the transom of the vessel is such as to permit controlled launch of the submersible and towable body. The recovery operation is, of course essentially the reverse of the launch operation discussed above. The skewable A-frame has one foot being at the pivot point 200 for the transom arm, and the other foot being at the point 202 where load from the apparatus is transferred to the vessel above the pivot and load transfer point 200. The apex of the skewable A-frame is defined at the axis of rotation of the sheave 114.

In the usual circumstance, a pair of transome arms 206 are pivotally mounted to the transom 208. As noted, the upper ends of the transom arms are adopted to bearingly support the sheave 114. The points 200 at which the transom arms 206 mount to transom 208 of the vessel are, of course, below the winch 108.

Figures 5, 6:
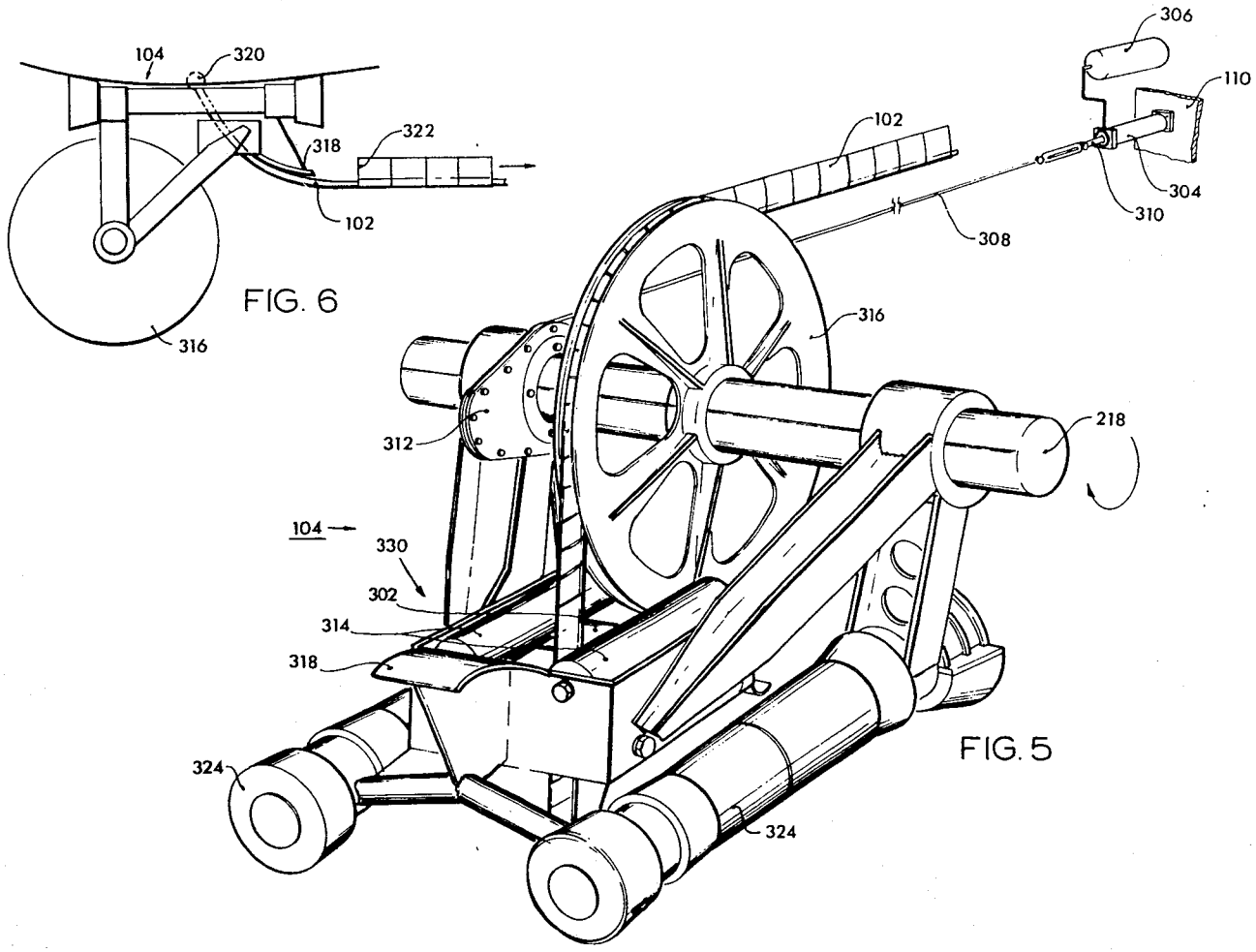
FIG. 5 is a side elevation of an alternate embodiment of apparatus according to this invention, when the apparatus is in its inboard position.
FIG. 6 is a view similar to FIG. 5 showing the apparatus of FIG. 5 in the extended, outboard position for launch and recovery of a towed body.

An alternative transom arm arrangement is indicated in FIGS. 5 and 6. In this embodiment, there is at least one transom arm 900, and usually a pair of transom arms which are pivotally mounted at their lower ends 906 to the transom 920. The upper ends of the transom arms 900 are adapted to bearingly support a sheave 922 which is rotatably mounted with its axis of rotation indicated at 908. Once again, the sheave 922 is physically situated lengthwise along the cable 924 which is reeled and unreeled from winch 926. [In this embodiment, winch 926 is shown as being essentially open and having side frame members 928 supporting it.]

At least one hydraulic ram or cylinder 904 is pivotally mounted to the deck of the vessel at 914, and is also pivotally mounted at its other end 916 to a tilt arm 902 which supports the entire assembly including winch 926 and side supports 928 from its upper end at 912. The tilt arm 902 is pivotally mounted to the deck of the vessel at 910.

When the apparatus of FIGS. 5 and 6 is to be tilted so as to swing the transom arm 900 backwardly and downwardly with respect to the vessel to bring sheave 922 and the saddle 930 into close proximity with the air/water interface, the hydraulic ram 904 is actuated and the tilt arm 902 is driven upwardly and backwardly from the position shown in FIG. 5 to the position shown in FIG. 6. Of course, the transom arm drives backwardly and downwardly, as shown, and a skewable A-frame is formed between the lower pivotal point 906 of transom arm 900, the axis 908 (about which the upper end of transom arm 900 and sheave 922 are rotatable), and the stop 918 against which the deck frame 932 is driven by the motion of tilt arm 902 and through which point load is transferred from the deck frame 932 including winch 926 etc. to the vessel.

The towing position of the apparatus of FIGS. 5 and 6, is of course, as indicated in FIG. 5 with the transom arm 900 swung upwardly to its original, stowage position.

Figures 7, 8:
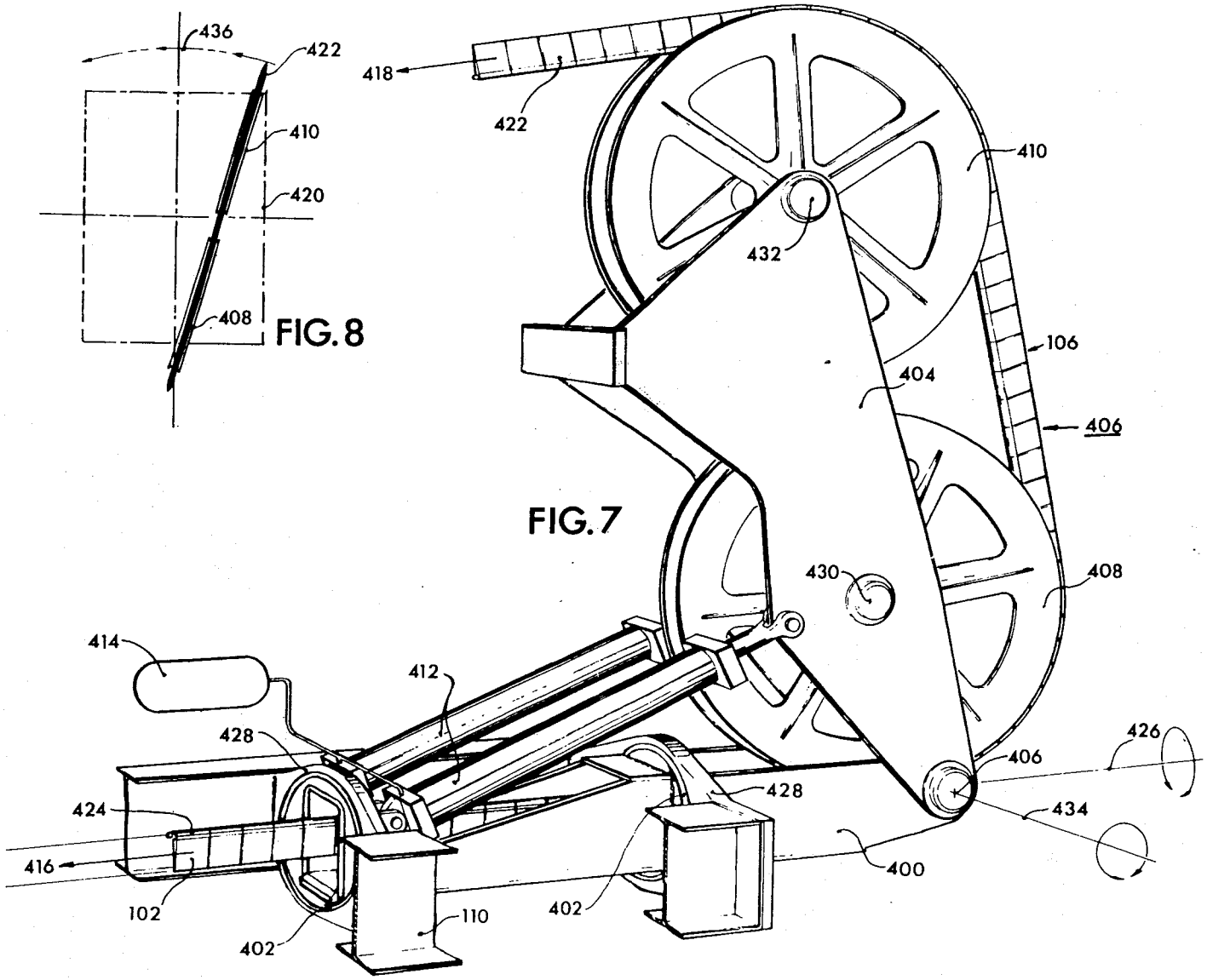
FIG. 7 is a perspective view showing a preferred embodiment of a cable spooling assembly according to this invention, and including cable tension stabilizer means.
FIG. 8 is a diagramatic view showing the relationship between the cable spooling assembly of FIG. 7 and a winch drum.

FIG. 7 shows a cable spooling and level winding assembly and a cable tension stabilizer assembly which are generally indicated at 106 in FIGS. 1 to 4. It will be noted in FIGS. 1 to 4 that cable 102 is reeled forward from the top of the winch 108 past the cable spooling assembly 106 and thence rearwardly to the sheave 114. The assembly 106 includes a beam or first arm 400 which is rotatably mounted in a pair of bearings 402. Bearings 402 are supported in housings 428 which are attached to the deck frame 110. The beam 400 essentially comprises a box section so that the faired cable 102 can move freely along the beam, substantially along the longitudinal axis thereof indicated at 426. A second arm or pair of arms 404 is rotatably mounted at 406 to the first arm 400. Sheaves 408 and 410 are bearingly mounted in the arms 404 at 430 and 432 respectively. The axis of rotation 434 of the rotatable mounting of arm 404 to arm 400 is substantially perpendicular to the axis of rotation 426 of arm 400 in bearings 402. It will be further noted, especially with reference to FIGS. 1 to 4, that the direction of the axis of rotation 434 is substantially parallel to the axis of the winch 108.

With reference to FIGS. 7 and 8 together, where FIG. 8 shows the relationship of sheaves 408 and 410 to a winch diagamatically indicated at 420, it will be noted that the upper cable reach 422 which extends to the winch 420 from the upper sheave 410 is substantially parallel to the lower cable reach 424. Also, it is noted that the uppr reach 422 is substantially at the same height as the top of the winch. The cable 102 is under tension, as indicated by arrows 416 and 418 on the lower and upper reaches 424 and 422 respectively. In this embodiment, the arm 400 is free to rotate in its bearing 402, and because the cable is in tension, the arm will rotate so that the upper cable reach 422 may describe an arc as indicated at 436 in FIG. 8, depending upon where the upper cable reach 422 is reeling or unreeling from the winch 108. Thus, the arm 404 pivots from side to side with arm 400 so as to achieve the shortest cable-run distance from the winch to the tow-off sheave with the cable in tension, and thereby provide level winding and a reduction of the fleet angle of spooling from the drum 420 of the winch 108 to the upper sheave 410 to substantially zero fleet angle. Because the lower cable reach 424 is substantially coaxial with the axis of rotation 426 of the arm 400, there is no fleet angle between the lower sheave 408 and the tow-sheave.

Another feature of the apparatus illustrated in FIG. 7 is that it includes a cable tension stabilizer which comprises a pair of shock absorbers which, in this case, are hydraulic cylinders 412. The hydraulic cylinders 412 are pressurized from an oil/gas accumulator 414, and are mounted between the arm 404 and 400. Thus, the arm 404 is biased so as to resist pivoting motion about its rotational axis 434.

When a transient load increase occurs in the cable 102, thereby increasing the cable tension as shown at 416 and 418, a torque is created by the cable 102 on the arm 404 about axis 434, and acts against the shock absorber 412 so as to damp out the transient load. Such loads may occur because of the vessel's movement in rough water during towing. FIGS. 2 and 4 show the upper sheave rotated backwardly at position 410A, in ghost lines; and in normal operating conditions, the position of the sheave 410 may be somewhat as indicated in FIGS. 2 and 4. Of course, arm 404 and sheave 408 are also swung forwardly — or to the right as indicated in FIG. 7 — and the cylinders 412 are extended or partially extended under the influence of pressure from the accumulator 414. Other shock absorber means may be provided, acting forwardly with respect to the fore-and-aft direction of the vessel against the arm 404.

An alternative cable spooling and level winding assembly and shock absorber assembly is shown in FIG. 9, 10, and 11. That assembly is very similar to the cable spooler assembly indicated together with the other apparatus shown in FIG. 5 and 6; and it will be noted that a single spooling sheave 964 is a feature of this embodiment. A longitudinal horizontal arm 950 is pivotally mounted between two frame mounted bearing plates 952 and 954. A pair of arms 956 and 958 are commonly mounted on rotational axis 960 which is near the end of arm 950 and substantially perpendicular thereto. The axis 960 is substantially parallel to the axis of winch 926 of FIGS. 5 and 6, and also to axis 962 of sheave 964 which is bearingly and rotationally mounted at the upper end of arms 956 and 958. [It should be noted that the apparatus of FIG. 9 is turned end-to-end with respect to the way it is to be seen in FIGS. 5 and 6.]

Once again, cable 102 is wrapped around the sheave 964 and passes from the winch 926 to the towing sheave 922 of FIGS. 5 and 6. A cable stabilizer comprises a pair of shock absorbers such as hydraulic cylinders 966 and 968 which connect the arms 956 and 958 respectively to the arm 950. Hydraulic cylinders 966 and 968 are connected at their lower ends to the arm 950 through a cross-shaft 970. The hydraulic cylinders 966 and 968 are pressurized by a suitable gas/oil accumulator and act to damp out transient cable loads in the cable 102 substantially in the same manner as described above with respect to the cable tension stabilizer means shown in FIG. 7.

Figure 17:
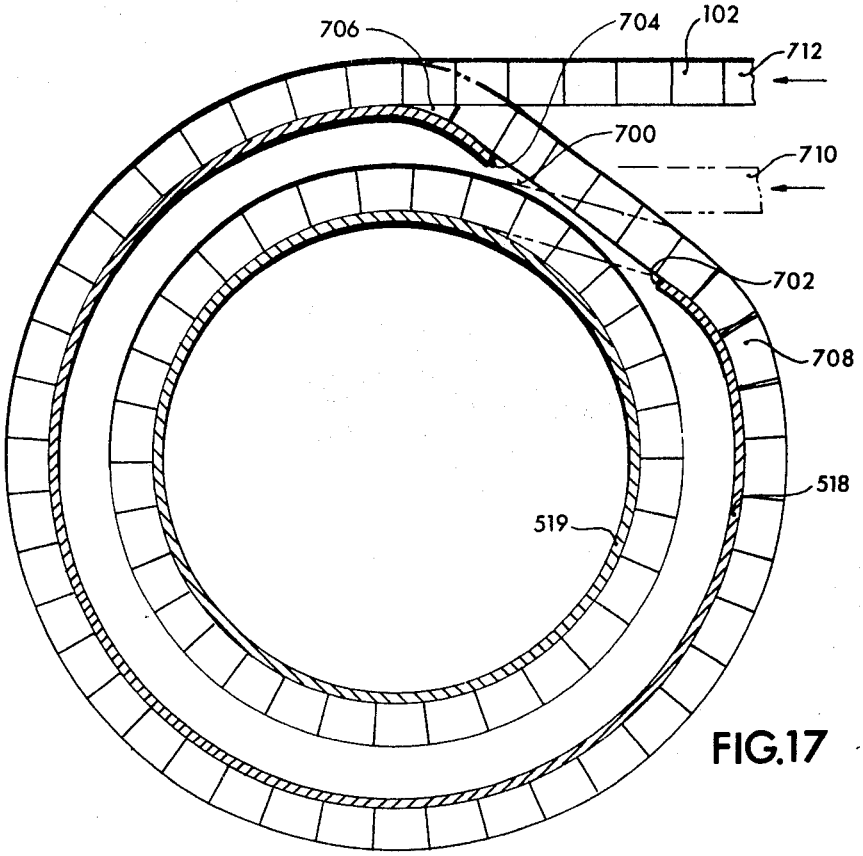
FIG. 17 is a diagrammatic cross-sectional view of a double drum winch as contemplated by this invention.

The spooler sheave 964 is usually considerably smaller than a winch drum such as that which is indicated diagramatically in FIG. 10 at 972. It therefore becomes necessary to power drive the spooling sheave 964 athwartships of the vessel so that the upper cable reach 984 from the sheave to the winch drum 972 falls substantially into longitudinal alignment with the point on the winch drum from which the cable is reeling. One manner by which the spooling sheave 964 may be driven athwartships is shown in FIG. 17, including a gear reducing box 974 which has a drive input 976 coming from the winch drum as the drum is rotating for reeling or unreeling of cable therefrom. A rotary output of the gear reducer box 974 takes the form of a crank arm 978 upon which a cam follower 980 is fitted. The cam follower 980 is engaged with a cam 982 which is so profiled as to cause the spooler sheave 964 and the arms 956, 958, and 950 together with the shock absorber cable tension stabilizer assembly to pivot about an axis 986 which is substantially longitudinal of the arm 950. The rate of drive and the camming arrangement is such as to drive the spooling sheave 964 in increments of one pitch of the cable which is reeled on the winch drum 972 per turn of that drum.

Figure 12:
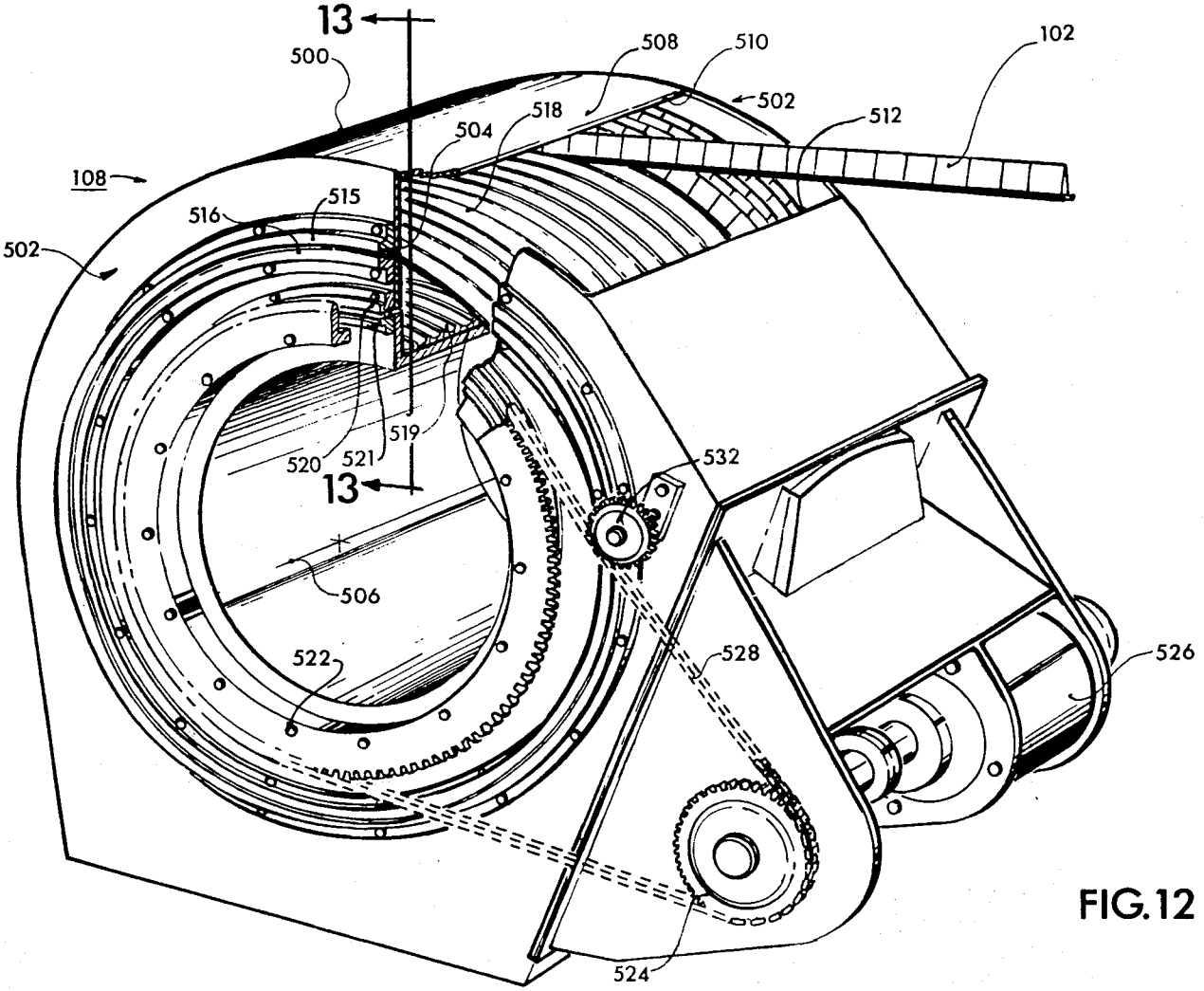
FIG. 12 is a perspective, partially fragmented view of a multi-drum winch assembly and its frame.
Figure 13:
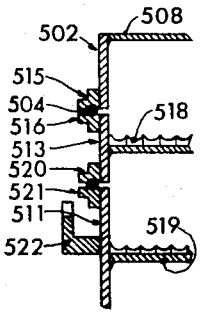
FIG. 13 is a partial cross section along the lines 13 13 of FIG. 12.

FIGS. 12 and 13 show more detail as to the construction of the winch assembly 108. The winch construction includes a substantially cylindrical enclosure designated generally at 500, which in turn comprises a pair of ends noted generally at 502, which ends are joined by an enclosure plate 508. A transverse slot which is defined at its transverse edges at 510 and 512 is formed in the enclosure plate 508, and is formed from one end 502 of the frame 500 to the outer end 502. The faired tow cable 102 may be reeled or unreeled through the transverse slot onto one or a plurality of drums which may be co-axially mounted within the frame 500, as discussed hereafter.

A drum assembly is mounted within the frame 500 on axis 506. The innermost drum — in a multi-drum assembly — is driven at a sprocket 522 which is rigidly secured to the drum by a drive transfer means such as chain 528 which in turn is driven by a drive sprocket 524 suitably coupled to a drive means such as an hydraulic or electric motor 526. An idler gear 532 is mounted on one of the ends 502.

Whether there is a single drum or a multi-drum assembly within the frame 500, the drum assembly is bearingly supported between the ends 502. In the embodiment illustrated in the FIGS. 12 and 13, two drums 518 and 519 are co-axially mounted about the axis 506, with drum 519 being the inner drum which is rigidly secured to and driven from sprocket 522. The bearing support means for each of the drums 518 and 519 includes, in each case, a pair of opposed circular races with bearings between them. The outer drum 518 is bearingly supported between the end 502 by a pair of races 515 and 516 which form a suitable bearing aperture 504 between them. Suitable roller or ball bearings are carried therein. In like manner, the inner drum 519 is bearingly supported to the end of plate 502 to the end 513 of the outer drum 518. A circular race 520 is secured to the end plate 513 of the outer drum 518, and an opposed race 521 is secured to the end plate 511 of the inner drum 519. Latch means are also provided, as discussed hereafter, to latch the drums for rotation or non-rotation with respect to the frame 500, depending upon which of the drums may be having cable reeled or unreeled therefrom.

It will be noted that the winch construction illustrated in FIGS. 12 and 13 provides a winch having multi-drum capacity, as recalled, and which has quite a substantial lateral rigidity within a lateral space requirement which is very little wider than the width of the drums accommodated in the winch structure. The enclosure plate 508, of course, provides substantial protection for the faired cable 102 which is stowed within the winch structure. Also, as noted, the faired cable 102 is normally stowed in tension, so that the frame 500 including ends 502 and enclosure plate 508 provides a substantial protection for personnel working in the area of the winch 108, in the event of a cable break. A guard, such as guard 529 shown in FIG. 1 is suitably provided over the drive transfer chain 528 and the sprockets 524 and 522 to protect them from icing and other weather conditions, dirt, etc., as well as to protect personnel working near the winch 108.

It will be seen, particularly upon reference to FIGS. 12 and 17 — as well as upon reference to the Hale U.S. Pat. No. 3,576,295 mentioned above — that when a multi-drum assembly is provided, it is necessary also to provide suitable latching means to latch any adjacent pair of drums together for rotation or for non-rotation — relative to the static 500 — as the case may be, depending on whether cable is being reeled or unreeled in a particular drum or one adjacent to it. Thus, cable is stored on each of the drums in a multi-drum assembly, but is unreeled first from the outermost drum and thence serially inwardly to the innermost drum; and as a corollary thereto, cable is reeled on the innermost drum first and thence outwardly serially to the outermost drum. In the most simple multi-drum assembly, being a two-drum assembly such as that illustrated in FIGS. 12 and 17, cable is reeled off the outer drum and then off the inner drum, and reeled onto the inner drum and then onto the outer drum.

Referring to FIGS. 12, 13, 15, 16 and 14A to 14G, an automatic latch means is described showing the manner in which drum 518 may be latched to drum 519 to be driven therewith or latched in non-rotating position so as to allow only drum 519 to be driven.

Referring specifically to the Figures, it will be seen that the latch means comprises a plurality of levers, as follows. A first lever 600 is directly coupled to a shaft 610 which is rotatably mounted in an end of the inner drum 519. A second lever, 608 is also directly coupled to the shaft 610. A third lever 602 is rotatably mounted to the end of the outer drum 518. A stop 606 is secured in non-rotating relationship to both of the outer drums 518 and 519, and may be suitably secured to the outer portion of the end 502 of the frame 500 of winch construction as shown in FIG. 12. Fourth and fifth levers 604 and 605 respectively are directly coupled to a shaft 607 which is rotatably mounted in the end of the outer drum 518.

Figures 14, 15, 16:
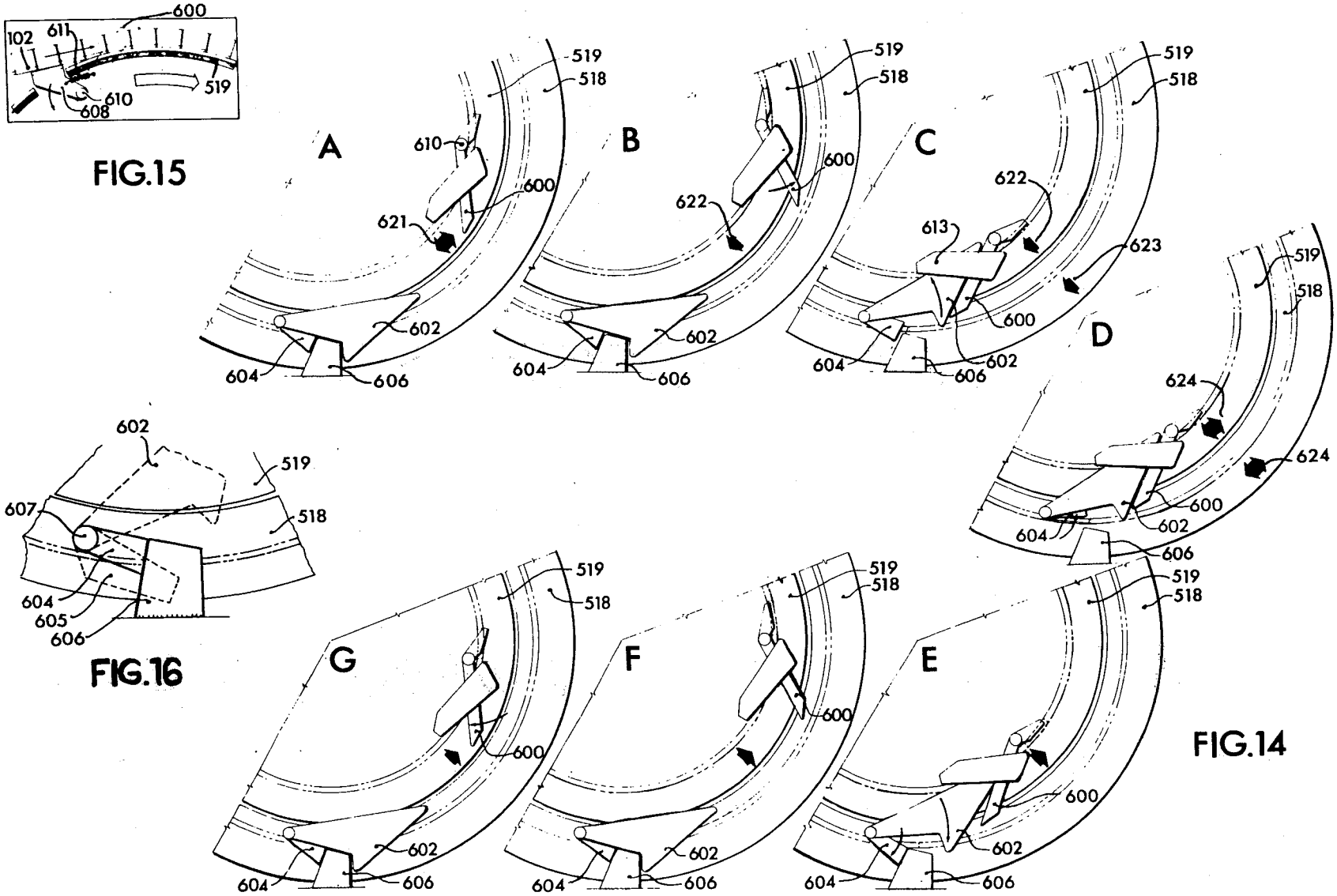
FIG. 15 is a partial view showing a detail of the latching mechanism.
FIG. 16 is a further partial view showing another detail of the latch mechanism.

The operation of the latch means is as follows. Referring to FIG. 14A, it will be noted that the outer drum 518 is secured in non-rotating position by the interaction of both of levers 602 and 604 with the stop 606. When the first lever 600 is in the position substantially as shown in FIG. 14A — that is, it does not extend radially outwardly at the end of drum 519 beyond the outermost extension of the drum — drum 519 is adapted to be rotated in either clockwise or counter-clockwise direction, as indicated by arrow 621. The first lever 600 has operative and non-operative positions, the non-operative position being such as indicated in FIG. 14A when the inner drum is not completely filled with cable being wound thereupon. The shaft 610 upon which levers 600 and 608 are directly coupled, is rotatably mounted and situated in the end of drum 519 in a position so that when the last half turn of cable is being wound onto the inner drum 519, the second lever 608 is depressed by the cable, and the first lever 600 is rotated by being directly coupled to the shaft 610 which itself is rotated by lever 608 being depressed, so that lever 600 assumes its operative position. FIG. 15 clearly shows the manner in which the lever 600 is depressed by the last half-turn of the cable 102 as it is wound onto the drum 519. [When the cable is being wound onto drum 519, the drum is being driven in the clockwise direction as shown by arrow 622 in FIG. 14B.] It is also shown in FIG. 14B that the operative position of lever 600 is such that it extends radially beyond the outer radial limit of the drum 519. Reference to FIG. 14C shows that the lever 600 is engageable when in its operative position against lever 602, which is then rotated out of engagement with stop 606, so that drum 518 is released so as to rotate in a clockwise direction as indicated by arrow 623. It is seen, therefore, that lever 602 cooperates with stop 606 to preclude rotation of the outer drum 518 in the reeling direction of that drum. It is also seen that when levers 600 and 602 are engaged, and rotation of the lever 602 is stopped by a stop 613, the drive which is imparted to the drum 519 is also transferred to drum 518, which rotates together with drum 519 and at the same rotative speed therewith.

As the first half turn of cable is wound onto the drum 518, it engages the lever 605 which is directly coupled to shaft 607 to which lever 604 is also directly coupled. The lever 604 is therefore rotated to its non-operative position, out of co-operation with the stop 606. In that condition — i.e. when cable is wound onto drum 519 and at least a half turn of cable is wound onto drum 518 — each drum is free to rotate in either direction as indicated by arrow 624 in FIG. 14D.

When cable is unreeled from drum 518, as the last half turn is removed from the drum, lever 605 is returned to the position shown in FIG. 16 so that lever 604 engages with stop 606. During unreeling from drum 518, both drums 518 and 519 are driven in the counter-clockwise direction. It is thus seen that the operative position of lever 604 is such as to co-operate with stops 606 to preclude rotation of the outer drum 518 in the unreeling direction of rotation thereof.

As the first half-turn is unreeled from inner drum 519, lever 608 returns to its original position — and may be biased by such as spring 611 shown in FIG. 15 — so that lever 600 disengages from lever 602, and lever 602 re-engages with stop 606 and co-operates therewith so as to preclude rotation of drum 518 in the reeling direction of rotation thereof. The condition of all of the levers which comprise the latch means as shown in FIG. G is, therefore, substantially identical to the condition of those levers as they are shown in FIG. A.

FIG. 17 is a diagrammatic representation of a typical two-drum assembly, comprising inner drum 519 and outer drum 518. A transverse slot 700 is formed in the outer drum 518 between the lips 702 and 704. The width of the slot 700 is such as to permit cable to be reeled or unreeled from drum 519 when drum 518 is non-rotative. The distance between drums 519 and 518 is such that when a faired cable 102 under tension is stowed on the drums, there is no interference of the cable on drum 518 with the cable on the drum 519 through the slot 700.

The material of the drum 518 is profiled in the region of lips 702 and 704 so that the apparent radius of curvature of the material is less than the nominal radius of the drum, and each lip curves noticeably inwardly towards the interior of the drum. It is preferable that the lip be so formed that the edges 702 and 704 of the transfer slot 700 underlie the cable which lies across the slot and is curved away from contact therewith. In this manner, radial loads which are induced by the cable tension of cable 102 in the drum 518 are reduced to zero at the edges of the radial slot.

It will be noticed, of course, that when the cable 102 is being reeled or unreeled from drum 519, it will be in the position as indicated at 710; and when the reeling transfers to drum 518, the cable lifts onto the drum 518 past the lip 702. The cable then assumes the position indicated at 712 for reeling or unreeling from outer drum 518.

The reduced curvature in the region of the lips 702 and 704 is such that there is an increase in section modulus of the material of the drum 518, and therefore a reduction of stress in the drum. It is therefore possible to provide the slotted drum 518 having a strength capability to withstand reeling, unreeling and stowage of cable under tension thereon, and which strength capability is substantially equal to that of the conventional unslotted drum of the same nominal diameter.

Figure 18:
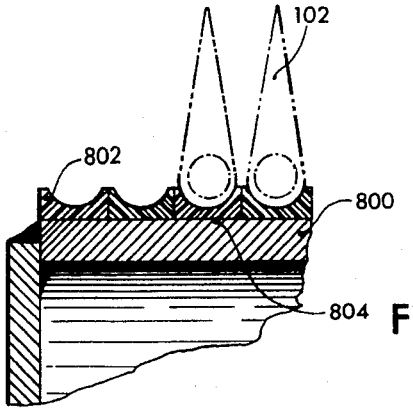
FIG. 18 is a partial cross-sectional view showing a typical assembly at a drum surface.

When a faired cable is wound onto a drum, it is desirable to include a helical groove on the outer surface of that drum. In the past, such helical grooves have been machined into the surface of the drum with the commensurate high machining and material costs. The present invention contemplates the formation of a grooved outer surface for a drum by securing to the surface of a plain drum an outer layer of a relatively flexible material which has a suitable cross-section. Thus, an extrusion such as that indicated at 802 in FIG. 18 may be secured to the face of a drum indicated at 800, with an interface 804 which may suitably be an adhesive. Relatively flexible materials which are suitable for application to the surface of the drum so as to form a groove surface thereon, include aluminum extrusions and rigid or semi-rigid vinyl or other suitable plastics.

It has been noted that, in the usual circumstance such as illustrated in FIGS. 1 to 6, the saddle is an inverting saddle against which the towed body is securely held when in its stowage position, and which inverts to permit passage of the towed body through the air/water interface. In that case, a saddle such as saddle 104 shown in FIG. 19, may be used. The saddle assembly 104 includes suitable bumpers or rollers 324 is provided, and the bumpers 324 are such that the towed body may be securely held and nested against them. The saddle 104 is rotatable about the axis of rotation 216, which is also the axis of rotation of the tow sheave 316. It has been noted that it is desireable to provide mens whereby a substantially constant pressure of contact can be maintained against the nose of the cable 102 when the body is being towed; and also that the body may tow very nearly beneath the vessel, even at high speeds when the cable is properly faired. The angle that the faired cable 102 makes with the nominal surface of the water is the piercing angle, and is shown in FIG. 4 at 300. It has also been noted that other, non-inverting saddles may be used, such as the saddle indicated generally at 326 in FIG. 21. That saddle may be mounted to pantograph arms 328 and 330, and the latter arms may be rotatably mounted and bearingly support a shaft 332 upon which tow sheave 316 is rotatably mounted. (The Jareckie U.S. Pat. No. 2,780,196, referred to above, shows the use of a pantograph assembly.)

Figure 21:
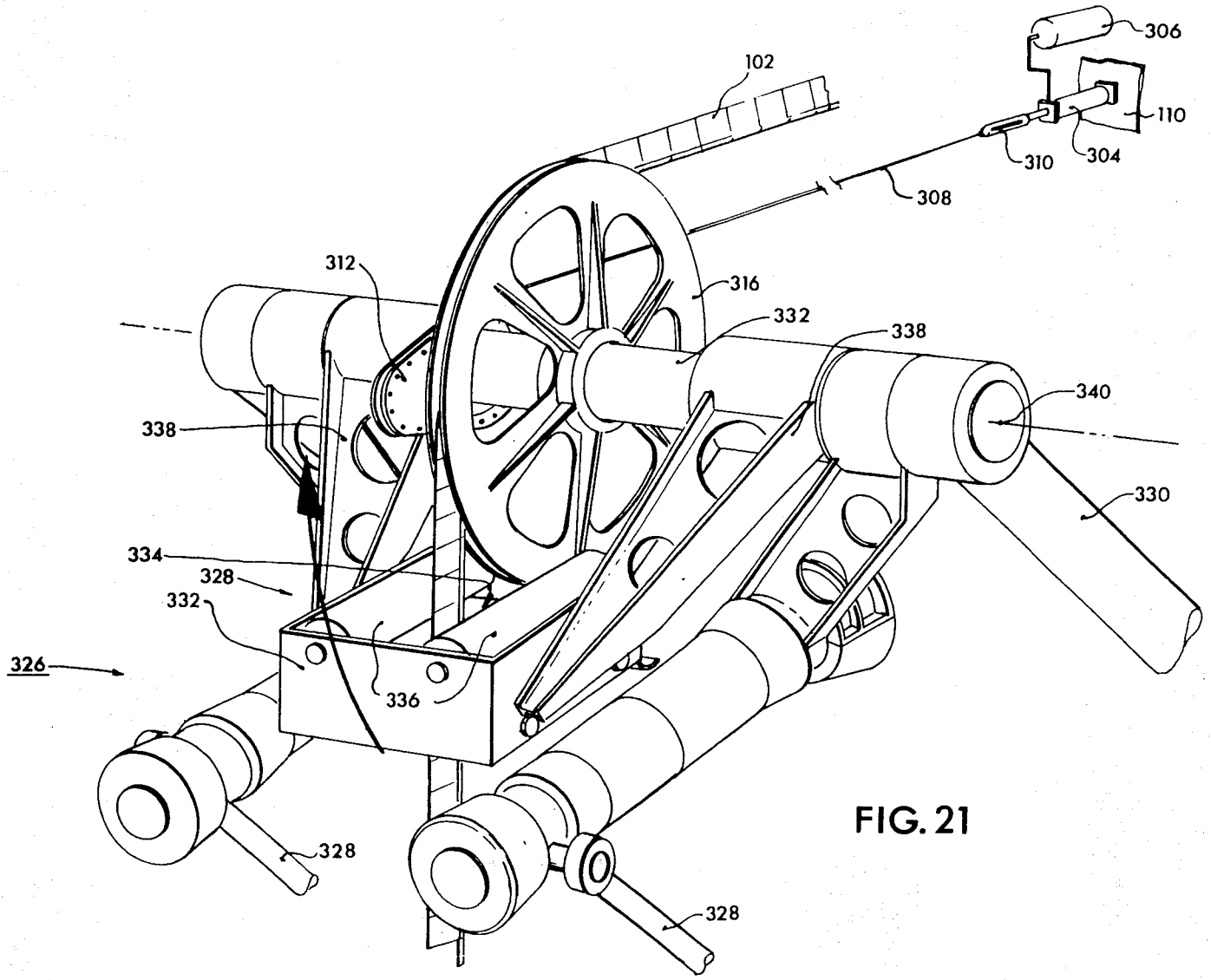
FIG. 21 is a perspective view of an alternative saddle assembly, where the roller box is biased independently of the saddle.

The piercing angle 300 of the faired cable 102 changes as the speed of the vessel changes. Also, as the vessel turns or rolls, the faired cable 102 may assume a tow-off from the towing sheave 316; i.e. the cable does not tow straight from the tow sheave. It is important, of course, to keep the cable from escaping from the tow sheave, and provision is made by the invention contemplated herein for transferring side loads from the cable during tow-off. Such provision may include a roller box such as the roller box 328 shown in FIG. 21 or the roller box 330 shown in FIG. 19. In FIG. 21, roller box 328 includes a frame 332, a nose roller 334 and a pair of side rollers 336; and the roller box 328 is rotatably and bearingly mounted to the shaft 332 by arms 338. It will be noted, therefore, that the roller box 328 is free to rotate on the shaft 332 about the same axis of rotation 340 as that of tow sheave 316, independently of saddle 326.

Figures 19, 20:
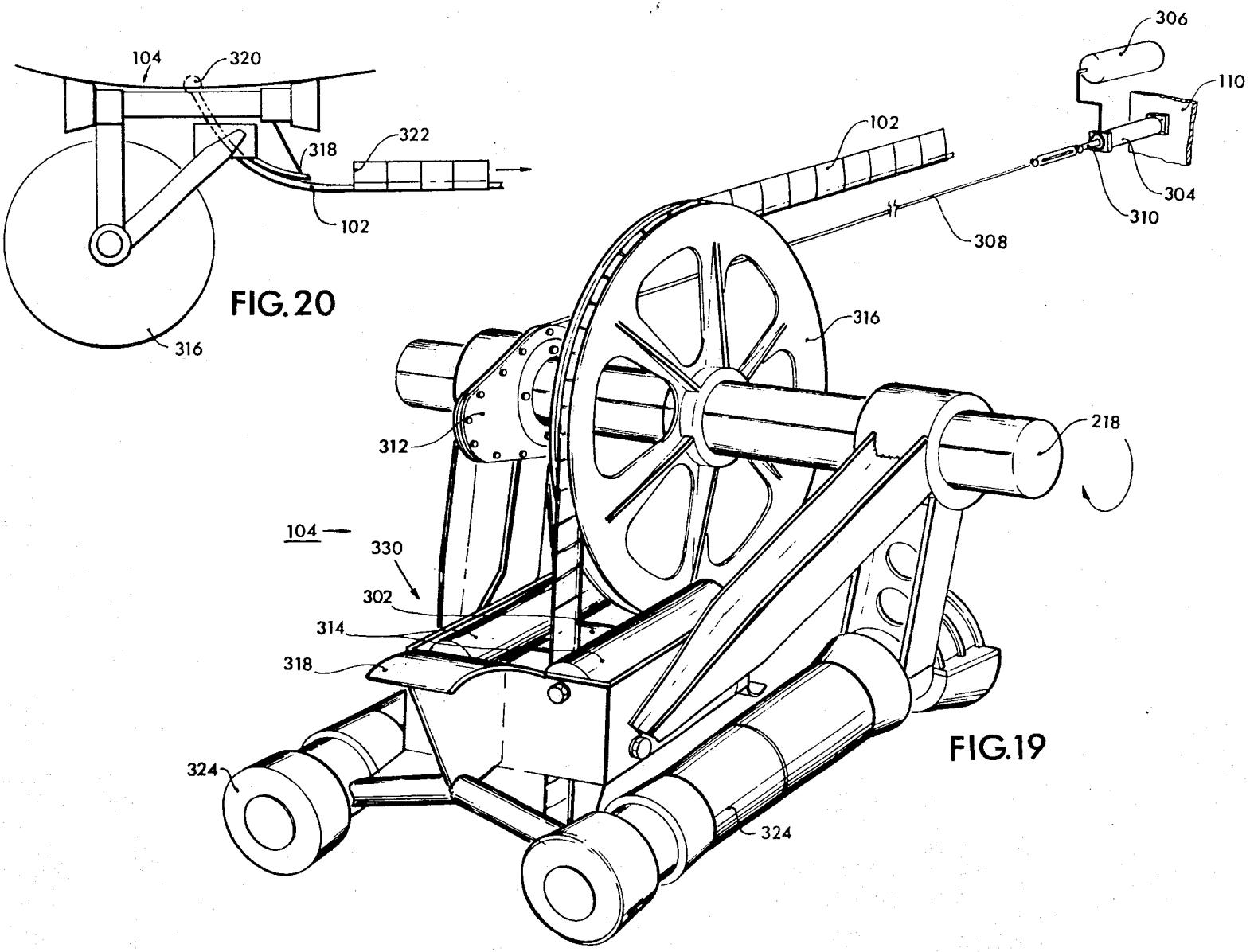
FIG. 19 is a perspective view of a saddle and roller box assembly according to this invention, together with its associated bias assembly.
FIG. 20 is a diagrammatic view showing the saddle of FIG. 19, together with a towed body and the cable, in the stowage position.

Because of the change of piercing angle, and the requirement to accommodate side loads during tow-off, it is important that the roller box be such as to maintain a substantially constant pressure of contact between the nose roller and the cable; and it has been found that it is best when the direction of the axis of the nose roller and the direction of the axis of the cable as it passes through the roller box and contacts the nose roller be substantially perpendicular. Also, during tow-off when there may be contact by the cable to either of the side rollers, it has been found to be best when the direction of the axes of the side rollers are substantially perpendicular to the direction of the axis of the cable so as to preclude any tendency of the cable to "corkscrew" during interference of the cable with either side roller. Thus, it is desireable to provide the roller box so that the direction of the axes of the side roller, the direction of the axis of the nose roller and the direction of the axis of the cable as it passes through the roller box during normal towing operation, are all mutually perpendicular. These principles hold true both with respect to the roller box 328 which is free to rotate about axis 340 independently above saddle 326, as shown in FIG. 21; and roller box 330 which is mounted for rotation together with the saddle 104, about axis 218, as shown in FIG. 19.

Bias means are therefore provided to effect rotation of the roller box about its axis of rotation; particularly so as to maintain substantially constant pressure of contact between the nose roller and the forward edge of the cable. With reference to the roller box 330, the nose roller is indicated at 302 and the side rollers at 314; while in roller box 328, the nose roller is indicated at 334 and the side rollers at 336. The bias means is the same for each roller box, and includes a spring means such as an hydraulic cylinder 304 which is attached to the deck frame 110 in a convenient place. The hydraulic cylinder is conveniently pressurized by gas/oil accumulator 306. A cable 308 is attached to the hydraulic cylinder 305 and is wrapped around and terminates at cam 312 at the cable end remote from the cylinder 304. The cam 312 is securely fixed to the saddle box 328 or 330, so that as the cam rotates under the influence of the spring means such as hydraulic cylinder 305, the respective roller box also rotates therewith. The spring means biases the roller box upwards so as to maintain a substantially constant pressure between the nose roller 302 or 334 and the cable 102 as it passes through the roller box.

The shape of the cam is profiled to provide a variable torque to the roller box due to the bias effect of the spring means, so as to take into account the shifting centre of gravity of the roller box (or roller box and saddle combined) as it rotates. Thus, the cam is profiled to provide a biasing torque to the roller box which varies substantially directly as the amount which the centre of gravity changes position, and is therefore a function of that change.

The design of the cam 312 may also take into account the fact that as the cylinder 304 retracts, the gas pressure in the gas/oil accumulator 306 reduces. The torque arm generated by the cam 312 (being the distance between cable 308 and axis 216 or 340), must increase because of the combined effect of the shifting of the centre of gravity of the roller box and the reduced biasing effort supplied by the cylinder 304.

There is shown on the roller box 330 of FIG. 19 a curved plate 318 which curves away from the frame and from the nose roller 302 therein at the end of the frame remote from the nose roller. The purpose of the plate 318 is as a cable depressor, and is shown diagramatically in FIG. 20. There, it will be seen that when the submersible and towable body is secured into the saddle 104 by the tension in cable 102, and the saddle is inverted as shown, the cable reach from the saddle is lifted off the tow sheave 316 and the cable pull is horizontal. It has been mentioned above that when the towed body is launched, the deck frame is tilted on the skewable A-frame before the saddle is inverted as shown, the cable reach from the saddle is lifted off the tow sheave 316 and the cable pull is horizontal. It has been mentioned above that when the towed body is launched, the deck frame is tilted on the skewable A-frame before the saddle is inverted to insert the towed body through the air/water interface, the length of cable which is unreeled from the winch remains constant. Thus, plate 318 depresses the cable so as to maintain tension therein; and therefore the fairings which are applied to the cable stop short of the tow point 320 on the towed body, at a point 322.

There has been described an improved apparatus for launching, towing and recovering a submersible and towable body from a vessel, including; apparatus having a transom arm which — together with a deck frame on which a winch, saddle and tow sheave are mounted — forms a skewable A-frame, and an alternative embodiment thereof; alternative embodiments of a cable spooler assembly and cable tension stabilizer; an enclosed winch construction for single or multi-drum assemblies to be rotatably mounted therein; an improved, automatic latching mechanism for latching adjacent co-axial drums in a multi-drum assembly for reeling and unreeling cable from any drum thereof; an improved drum construction having stress relief and an inexpensive grooved surface; and alternative embodiments of a roller box and saddle assembly for maintaining constant nose pressure against the cable during towing, and for accommodating side loading during tow-off.

It is not intended that the preceeding discussion be limiting with respect to the invention described herein, but illustrative of principles and concepts involved.

I claim:

1. For use in association with a winch for reeling and storing cable, where said winch is rotatable about an axis, a cable spooling assembly comprising: first arm means bearingly supported in a direction substantially perpendicular to the axis of said winch, said first arm means being rotatable about the longitudinal axis thereof; second arm means mounted at a first end of said first arm means; at least one sheave rotatably mounted on and bearingly supported by said second arm means; the arrangement being such that cable passes over said at least one sheave to reverse its direction of travel from its point of initial contact with said at least one sheave back towards a winch when cable is being reeled onto the winch said sheave being so mounted on said second arm means relative to said winch that when said cable is reeled to or unreeled from said winch, said first arm means is caused to rotate about its longitudinal axis to provide level winding means for the cable whereby said at least one sheave traverses back and forth across said winch and position said at least one sheave in an attitude relative to said winch which permits reeling the cable to or unreeling the cable from said winch at a minimum fleet angle of the cable defined between said at least one sheave and said winch, said first arm being rotatable about its longitudinal axis so as to accommodate the cable reach between said sheave and said winch.

2. The apparatus of claim 1 where said second arm means is rotatable at the first end of said first arm means about an axis perpendicular to the longitudinal axis of said first arm means and parallel to the axis of rotation of said winch.

3. The apparatus of claim 2 including cable tension stabilizer means comprising shock absorber means mounted at a first end to said second arm means and fixed at a second end and biased so as to resist pivoting motion of said second arm about the first end of said first arm toward said winch.

4. The apparatus of claim 3 where said sheave means mounted on said second arm includes a lower sheave and an upper sheave aligned along said second arm and rotatably supported thereby.

5. The apparatus of claim 3 where a single sheave is bearingly mounted on said second arm; and further including drive means to rotatably drive said second and first arms and said sheave about the axis of rotation of said first arm as said cable is reeled or unreeled from said winch about said sheave at a rate so that the top of said sheave is substantially aligned with the reeling point on said winch.

6. The apparatus of claim 4 where the lower of said sheaves on said second arm is arranged so that the cable reach therefrom extends substantially along the longitudinal pivotal axis of said first arm means and beneath said winch; and where the upper of said sheaves on said second arm is at a height above the lower sheave so that the cable reach extends from the upper sheave to said winch at a height above said cable reach from the lower of said sheaves, the arrangement of the upper and lower sheaves on said second arm being such that said upper cable reach and said lower cable reach are substantially parallel to each other, said upper sheave being so positioned relative to said winch that when said cable is reeled to or unreeled from said winch, said first arm means is caused to rotate about its longitudinal axis to position the upper sheave in an attitude relative to said winch which permits reeling the cable to or unreeling the cable from said winch at a fleet angle of substantially zero of the cable defined between the upper sheave and the winch.

7. In a winch construction for reeling and storing cable where at least two drum means are rotatably and co-axially mounted, and the innermost of said drums is driven; and where it is intended that as between any pair of adjacent drums, co-axially, cable is reeled onto the inner drum first and off the outer drum first, there being a transverse slot in the outer of said drums to accommodate passage of the cable therethrough to the inner of said drums when said outer of said drums is held against rotation, and the outer of said drums has no cable wound upon it when cable is reeled to or unreeled from the inner of said drums; latch means comprising:

first lever means on the inner of said drums, directly coupled to a first shaft rotatably mounted in the end of said inner drum in a position near where the last half turn of the cable is reeled onto or off said inner drum; said first lever means having operative and non-operative positions, the non-operative position occurring when said inner drum is not completely filled; second lever means directly coupled to said first shaft and adapted to rotate said first shaft and said first lever so that when the last half turn of cable is on said inner drum, said second lever is depressed by said cable and said first lever is rotated by said first shaft to its operative position; third lever means rotatably mounted to the end of the outer of said drums, and engageable by said first lever means when in its operative position so as to be held thereby out of engagement with stop means secured in non-rotating relationship to both said inner and outer of said pair of drums;

said stop means being adapted to co-operate with said third lever to preclude rotation of said outer of said pair of drums in the reeling direction of rotation thereof; and fourth and fifth lever means directly coupled to a second shaft which is rotatably mounted in the end of said outer of said pair of drums; said fourth lever means having operative and non-operative positions, the non-operative position occurring when more than a half turn of cable is wound on said outer of said drums;

said fifth lever means being mounted so as to be depressed by said cable when a half turn of cable is wound on said outer of said drums; so that when no cable is on said outer of said drums, said fourth lever is rotated on said second shaft to its operative position where it co-operates with said stop means to preclude rotation of said outer of said pair of drums in the unreeling direction of rotation thereof.

8. The latch means of claim 7 further comprising bias means to return said first and second lever means on said first shaft means to the rotative position of said first shaft where said first lever is in its non-operative position.

9. The latch means of claim 8, further comprising stop means to limit rotative motion of said third lever means away from said stop means when said third lever means is engaged by first lever means.

10. A winch construction for reeling and storing cable comprising an enclosing supporting frame, at least two drum means co-axially supported by and mounted within said frame and upon which drum means cable may be reeled and unreeled; and drive means for driving said at least two drums, wherein:

said enclosing frame comprises first and second ends and an enclosure plate between said ends substantially enclosing said at least two drums; a transverse slot formed in said enclosure plate extending between said first and second ends; said at least two drums being bearingly supported between said first and second ends by bearing support means mounted in each of said ends so as to mount said drum within said enclosure plate and between said ends for rotation therein where each said drum is mounted with respect to the surrounding drum or frame by a pair of opposed circular races at each end of each such drum with bearing means between said races; and drive means for rotatably driving said at least two drums, including first sprocket means formed outwardly of one of said ends and rigidly secured to one end of the innermost of said drums, a drive sprocket, and drive transfer means between said drive sprocket and said first sprocket; and including latch means to securably latch the outermost drum against rotation with respect to said frame and further latch means to latch each drum against rotation relative to the next adjacent drum thereto; and a transverse slot formed in each said drum except the innermost of said drums, said latch means being further adapted to secure said drums for reeling or unreeling cable onto any one of said drums, serially from the outermost drum inwardly, by aligning each of said transverse slots one with another and with the transverse slot in said enclosure plate so that with respect to any drum on which cable is being reeled or unreeled, all outward drums, if any, are latched in non-rotating position with the transverse slots in each aligned, and all inward drums, if any, are latched for rotation with the innermost drum.

* * * * *